US010016871B2

(12) United States Patent
Shinozaki

(10) Patent No.: US 10,016,871 B2
(45) Date of Patent: Jul. 10, 2018

(54) POLISHING APPARATUS AND CONTROLLING THE SAME

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 386 days.

(21) Appl. No.: 14/977,518

(22) Filed: Dec. 21, 2015

(65) Prior Publication Data

US 2016/0184961 A1 Jun. 30, 2016

(30) Foreign Application Priority Data

Dec. 26, 2014 (JP) ..... 2014-266199

(51) Int. Cl.
*B24B 37/00* (2012.01)
*B24B 37/005* (2012.01)

(52) U.S. Cl.
CPC ..... *B24B 37/005* (2013.01)

(58) Field of Classification Search
CPC ... B24B 37/005; B24B 53/005; B24B 53/017; B24B 53/00; B24B 53/08
USPC ..... 451/5, 21, 26, 56, 443
See application file for complete search history.

(56) References Cited

U.S. PATENT DOCUMENTS 6,354,918 B1 * 3/2002 Togawa ..... B24B 53/017 451/283
6,953,382 B1 10/2005 Korovin et al.
9,108,292 B2 * 8/2015 Shimano ..... B24B 53/005
9,156,130 B2 * 10/2015 Shimano ..... B24B 37/005
2008/0146119 A1 * 6/2008 Sasaki ..... B24B 37/30 451/5
2010/0035525 A1 2/2010 Deshpande et al.
2010/0081361 A1 * 4/2010 Fukuda ..... B24B 53/017 451/5
2011/0159783 A1 * 6/2011 Fukushima ..... B24B 37/042 451/11
2012/0302064 A1 11/2012 Kojima
2012/0315829 A1 12/2012 Tanikawa et al.
(Continued)

FOREIGN PATENT DOCUMENTS

JP H11-048124 A 2/1999
JP 2000-000761 A 1/2000
(Continued)

OTHER PUBLICATIONS

Japan Patent Application No. 2014-266199; Decision to Grant; dated Feb. 19, 2018; 6 pages.

*Primary Examiner* — George Nguyen
(74) *Attorney, Agent, or Firm* — Baker & Hostetler LLP

(57) ABSTRACT

A polishing apparatus according to one embodiment includes: a turn table on which a polishing pad for polishing a substrate is provided; a turn table rotation mechanism configured to rotate the turn table; a dresser configured to dress the polishing pad by cutting a surface of the polishing pad; a pressing mechanism configured to press the dresser onto the polishing pad; a dresser rotation mechanism configured to rotate the dresser; a swinging mechanism configured to swing the dresser on the polishing pad; and a controller configured to control the pressing mechanism, the turn table rotation mechanism or the dresser rotation mechanism based on a position and a swinging direction of the dresser.

19 Claims, 14 Drawing Sheets

(56) References Cited

U.S. PATENT DOCUMENTS

| | | | | |
|---|---|---|---|---|
| 2013/0122783 | A1* | 5/2013 | Menk | B24B 37/042 451/11 |
| 2014/0065931 | A1* | 3/2014 | Shinozaki | B24B 49/18 451/56 |
| 2014/0349552 | A1 | 11/2014 | Nagai et al. | |
| 2016/0271749 | A1* | 9/2016 | Shinozaki | B24B 37/005 |

FOREIGN PATENT DOCUMENTS

| | | | |
|---|---|---|---|
| JP | 2010-076049 | A | 4/2010 |
| JP | 2011-530809 | A | 12/2011 |
| JP | 2012-245589 | A | 12/2012 |
| JP | 2012-254490 | A | 12/2012 |
| JP | 2014-042968 | A | 3/2014 |
| JP | 2014-223683 | A | 12/2014 |

* cited by examiner

FIG.6

| SWINGING DIRECTION i | CENTER → EDGE(i=0) | | | | | CENTER → EDGE(i=1) | | |
|---|---|---|---|---|---|---|---|---|
| POSITION j | 50 | 100 | 300 | 350 | | 300 | 100 | 50 |
| PRESSING FORCE Fd'(i, j) | Fd'(0, 50) | Fd'(0, 100) | Fd'(0, 300) | Fd'(0, 350)=Fd'(1, 350) | | Fd'(1, 300) | Fd'(1, 100) | Fd'(1, 50) |
| CONTROL SIGNAL Pset(i, j) | Pset(0, 50) | Pset(0, 100) | Pset(0, 300) | Pset(0, 350)=Pset(1, 350) | | Pset(1, 300) | Pset(1, 100) | Pset(1, 50) |

61

FIG.9

| SWINGING DIRECTION i | CENTER → EDGE(i=0) | | | | | CENTER → EDGE(i=1) | | | |
|---|---|---|---|---|---|---|---|---|---|
| POSITION j | 50 | 100 | | 300 | 350 | 300 | | 100 | 50 |
| CONTROL SIGNAL Nttset(i, j) | Nttset(0, 50) | Nttset(0, 100) | | Nttset(0, 300) | Nttset(0, 350)=Nttset(1, 350) | Nttset(1, 300) | | Nttset(1, 100) | Nttset(1, 50) |

61a

FIG.12

| SWINGING DIRECTION i | CENTER → EDGE(i=0) | | | | | CENTER → EDGE(i=1) | | | |
|---|---|---|---|---|---|---|---|---|---|
| POSITION j | 50 | 100 | | 300 | 350 | 300 | | 100 | 50 |
| CONTROL SIGNAL Ndrset(i, j) | Ndrset(0, 50) | Ndrset(0, 100) | | Ndrset(0, 300) | Ndrset(0, 350)=Ndrset(1, 350) | Ndrset(1, 300) | | Ndrset(1, 100) | Ndrset(1, 50) |

61b

POLISHING APPARATUS AND CONTROLLING THE SAME

CROSS-REFERENCE TO RELATED APPLICATIONS

This application claims the benefit of Japanese Priority Patent Application JP 2014-266199 filed on Dec. 26, 2014, the entire contents of which are incorporated herein by reference.

FIELD

The present embodiment relates to a polishing apparatus including a dresser for a polishing pad and a method of controlling the same.

BACKGROUND

A polishing apparatus represented by a chemical mechanical polishing (CMP) apparatus polishes a surface of a target substrate by moving a polishing pad and the target substrate relatively, in a state in which the polishing pad and the surface of the target substrate are made to contact each other. The polishing pad is gradually worn by polishing of the target substrate or minute unevenness of the surface of the polishing pad is collapsed, which results in decreasing a polishing rate. For this reason, dressing is performed on the surface of the polishing pad by a dresser with multiple diamond particles electrodeposited on a surface thereof or a dresser with brush implanted into a surface thereof to form the minute evenness is formed again on the surface of the polishing pad (for example, refer to JP 2014-42968 A and JP 2010-76049 A).

The dresser is pressed on the polishing pad, swings on the polishing pad while rotating, and cuts the surface of the polishing pad. To maintain polishing performance (particularly, uniformity of polishing or a predetermined polishing profile) for the target substrate, force cutting the surface of the polishing pad is preferably constant regardless of a position on the polishing pad. For this reason, it is general to control force of the dresser pressing the polishing pad constantly.

However, even though the force of the dresser cutting the polishing pad is constant, force of the dresser polishing the polishing pad is not always constant.

The present embodiment has been made in view of the above problem and an object of the present embodiment is to provide a polishing apparatus including a dresser capable of cutting a polishing pad with approximately constant force and a control method thereof.

SUMMARY

A polishing apparatus according to one embodiment includes: a turn table on which a polishing pad for polishing a substrate is provided; a turn table rotation mechanism configured to rotate the turn table; a dresser configured to dress the polishing pad by cutting a surface of the polishing pad; a pressing mechanism configured to press the dresser onto the polishing pad; a dresser rotation mechanism configured to rotate the dresser; a swinging mechanism configured to swing the dresser on the polishing pad; and a controller configured to control the pressing mechanism, the turn table rotation mechanism or the dresser rotation mechanism based on a position and a swinging direction of the dresser.

BRIEF DESCRIPTION OF DRAWINGS

FIG. 6 is a diagram illustrating an example of a structure of the table 61 included in the controller 6.

FIG. 9 is a diagram illustrating an example of a structure of the table 61*a* included in the controller 6.

FIG. 12 is a diagram illustrating an example of a structure of the table 61*b* included in the controller 6.

DESCRIPTION

Figure 1:
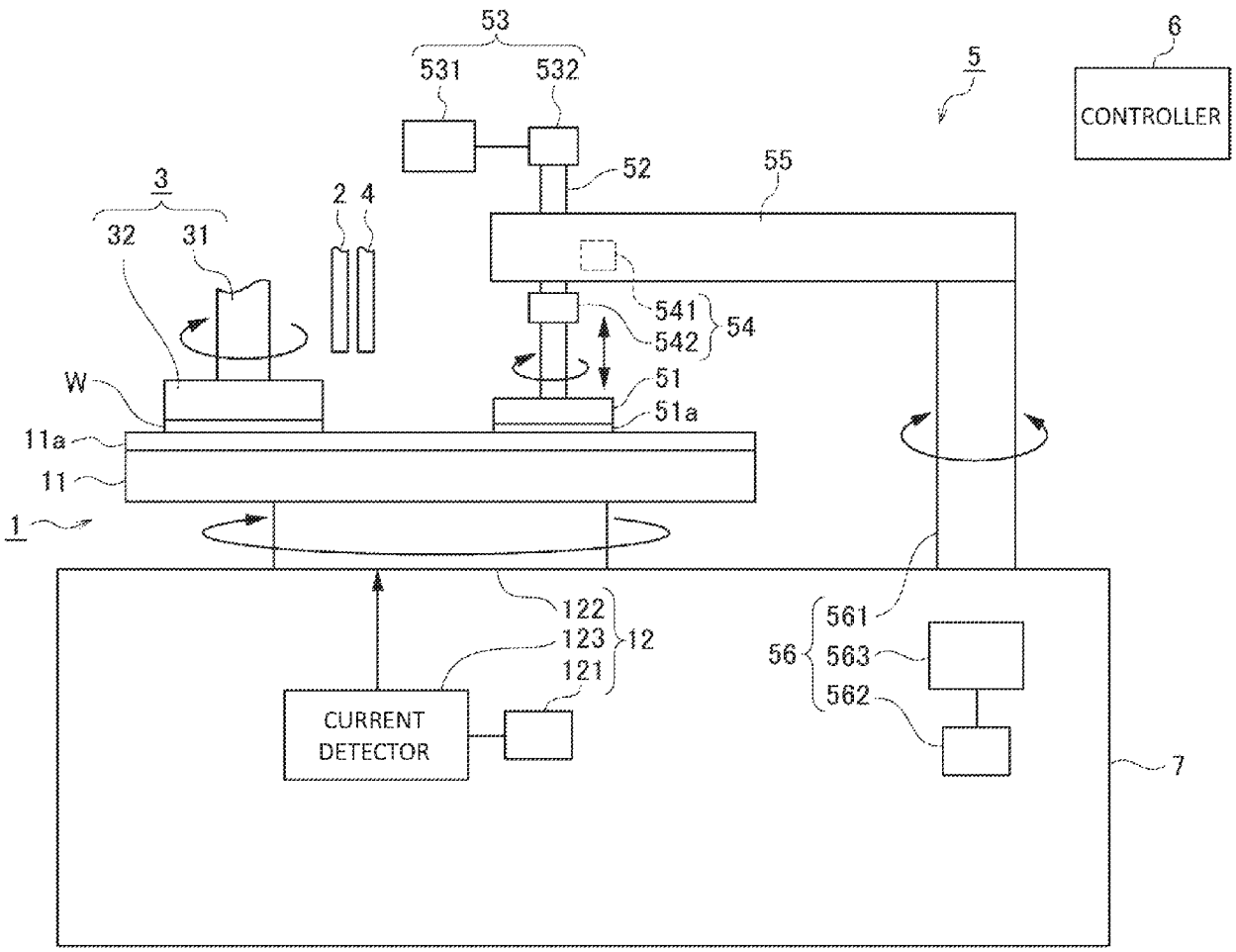
FIG. 1 is a schematic diagram illustrating a schematic configuration of a polishing apparatus.

According to one embodiment, a polishing apparatus includes: a turn table on which a polishing pad for polishing a substrate is provided; a turn table rotation mechanism configured to rotate the turn table; a dresser configured to dress the polishing pad by cutting a surface of the polishing pad; a pressing mechanism configured to press the dresser onto the polishing pad; a dresser rotation mechanism configured to rotate the dresser; a swinging mechanism configured to swing the dresser on the polishing pad; and a controller configured to control the pressing mechanism, the turn table rotation mechanism or the dresser rotation mechanism based on a position and a swinging direction of the dresser.

The controller may control the pressing mechanism, the turn table rotation mechanism or the dresser rotation mechanism so that a force of the dresser to cut the surface of the polishing pad becomes a target value.

The controller may control the pressing mechanism, the turn table rotation mechanism or the dresser rotation mechanism taking into consideration that a ratio between a force of the dresser to press the polishing pad and the force of the dresser to cut the surface of the polishing pad depends on the swinging direction of the dresser.

The controller may control the pressing mechanism to adjust a force of the dresser to press the polishing pad, controls the turn table rotation mechanism to adjust a rotation speed of the turn table, or controls the dresser rotation mechanism to adjust a rotation speed of the dresser.

The swinging mechanism may swing the dresser between a center of the polishing pad and an edge thereof, and the controller controls the pressing mechanism, the turn table rotation mechanism or the dresser rotation mechanism based on whether the swinging direction is a direction from the center to the edge or a direction from the edge to the center.

The controller may includes a table in which a control signal to set a force of the dresser to cut the surface of the polishing pad to become a target value for each position and swinging direction of the dresser is determined, the controller outputting the control signal depending on the position and the swinging direction of the dresser, and controls the pressing mechanism, the turn table rotation mechanism or the dresser rotation mechanism based on the control signal.

The controller may include a determiner configured to determine whether or not the control signal in the table is appropriate based on an actual force of the dresser to cut the surface of the polishing pad and the target value.

The determiner may include a memory which configured to store the position and the swinging direction of the dresser associated with a determination result.

The controller may calculate the actual force of the dresser to cut the surface of the polishing pad from: a driving current supplied to a turn table motor in the turn table rotation mechanism and the position of the dresser; from a distortion of a rotation axis of the turn table and the position of the dresser; from a force applied on a support member to support a rotation axis of the dresser; or from a force applied on a support member to support a support axis of the dresser.

According to another embodiment, a method of controlling a polishing apparatus, the polishing apparatus comprising: a turn table on which a polishing pad for polishing a substrate is provided; a turn table rotation mechanism configured to rotate the turn table; a dresser configured to dress the polishing pad by cutting a surface of the polishing pad; a pressing mechanism configured to press the dresser onto the polishing pad; a dresser rotation mechanism configured to rotate the dresser; and a swinging mechanism configured to swing the dresser on the polishing pad, the method comprising: detecting a position and a swinging direction of the dresser; and controlling the pressing mechanism, the turn table rotation mechanism or the dresser rotation mechanism based on the position and the swinging direction of the dresser.

According to another embodiment, a dressing method for cutting a surface of a polishing pad on a turn table, said method including: rotating the turn table and a dresser; cutting the surface of the polishing pad by pressing and oscillating the dresser against the polishing pad; detecting a position and a oscillating direction of the dresser on the polishing pad; and adjusting a pressing force of the dresser, a rotating speed of the turn table or a rotating speed of the dresser based on said detecting.

The pressing force of the dresser, the rotating speed of the turn table or the rotating speed of the dresser may be adjusted so that a force of the dresser to cut the surface of the polishing pad becomes a target value.

The pressing force of the dresser, the rotating speed of the turn table or the rotating speed of the dresser may be adjusted taking into consideration that a ratio between a force of the dresser to press the polishing pad and a force of the dresser to cut the surface of the polishing pad depends on the oscillating direction of the dresser.

The pressing force of the dresser may be adjusted by controlling a pressing mechanism which is configured to press the dresser onto the polishing pad; the rotating speed of the turn table is adjusted by controlling a turn table rotation mechanism which is configured to rotate the turn table; or the rotating speed of the dresser is adjusted by controlling a dresser rotation mechanism which is configured to rotate the dresser.

The dresser may be oscillated between a center of the polishing pad and an edge thereof, and whether the oscillating direction of the dresser is a direction from the center to the edge or a direction from the edge to the center may be detected.

The dressing method may further include outputting a control signal depending on the position and the oscillating direction of the dresser using a table in which the control signal is determined, the control signal being a signal to set a force of the dresser to cut the surface of the polishing pad to become a target value for each position and oscillating direction of the dresser, wherein the pressing force of the dresser, the rotating speed of the turn table or the rotating speed of the dresser may be adjusted based on the control signal.

The dressing method may further include determining whether or not the control signal in the table is appropriate based on an actual force of the dresser to cut the surface of the polishing pad and the target value.

The dressing method may further include storing the position and the oscillating direction of the dresser associated with a determination result.

The actual force of the dresser to cut the surface of the polishing pad may be calculated: from the position of the dresser and a driving current supplied to a turn table motor in a turn table rotation mechanism which is configured to rotate the turn table; from a distortion of a rotation axis of the turn table and the position of the dresser; from a force applied on a support member to support a rotation axis of the dresser; or from a force applied on a support member to support a support axis of the dresser.

A detailed description will hereinafter be given of embodiments of the present embodiment with consultation of drawings.

First Embodiment

FIG. 1 is a schematic diagram illustrating a schematic configuration of a polishing apparatus. The polishing apparatus polishes a substrate W such as a semiconductor wafer and includes a table unit 1, a polishing liquid supply nozzle 2, a polishing unit 3, a dressing liquid supply nozzle 4, a dressing unit 5, and a controller 6. The table unit 1, the polishing unit 3, and the dressing unit 5 are disposed on a base 7.

The table unit 1 has a turn table 11 and a turn table rotation mechanism 12 to rotate the turn table 11. A cross-section of the turn table 11 has a circular shape and a polishing pad 11*a* to polish the substrate W is fixed on a top surface of the turn table 11. A cross-section of the polishing pad 11*a* has a circular shape, similar to the cross-section of the turn table 11. The turn table rotation mechanism 12 includes a turn table motor driver 121, a turn table motor 122, and a current detector 123. The turn table motor driver 121 supplies a drive current to the turn table motor 122. The turn table motor 122 is connected to the turn table 11 and rotates the turn table 11 by the drive current. The current detector 123 detects a value of the drive current. As the drive current increases, a torque of the turn table 11 increases. For this reason, the torque of the turn table 11 can be calculated based on the value of the drive current.

The polishing liquid supply nozzle 2 supplies a polishing liquid such as slurry to a top surface of the polishing pad 11*a*.

The polishing unit 3 has a top ring shaft 31 and a top ring 32 connected to a lower end of the top ring shaft 31. The top ring 32 holds the substrate W on a bottom surface thereof by means of vacuum suction. The top ring shaft 31 is rotated by a motor (not illustrated in the drawings). As a result, the top ring 32 and the held substrate W rotate. In addition, the top ring shaft 31 moves vertically with respect to the polishing pad 11*a* by a vertical movement mechanism (not illustrated in the drawings) including a servo motor and a ball screw.

Polishing of the substrate W is performed as follows. The top ring 32 and the turn table 11 are rotated while the polishing liquid is supplied from the polishing liquid supply nozzle 2 to the top surface of the polishing pad 11*a*. In this state, the top ring 32 having held the substrate W is descended and the substrate W is pushed to the top surface of the polishing pad 11*a*. The substrate W and the polishing pad 11*a* slidably contact each other under the polishing liquid. As a result, the surface of the substrate W is polished and flattened.

The dressing liquid supply nozzle 4 supplies a dressing liquid such as pure water to the top surface of the polishing pad 11*a*.

The dressing unit 5 has a dresser 51, a dresser shaft 52, a pressing mechanism 53, a dresser rotation mechanism 54, a dresser arm 55, and a swinging mechanism 56.

A cross-section of the dresser 51 has a circular shape and a bottom surface of the dresser 51 is a dressing surface. The dressing surface is configured by a dress disk 51*a* with diamond particles fixed thereon. In the dresser 51, the dress disk 51*a* contacts the polishing pad 11*a* and cuts the surface of the polishing pad 11*a*, so that dressing (conditioning) is performed on the polishing pad 11*a*.

In the dresser shaft 52, the dresser 51 is connected to a lower end thereof and the pressing mechanism 53 is connected to an upper end thereof.

The pressing mechanism 53 elevates the dresser shaft 52 and the dresser shaft 52 descends, so that the dresser 51 is pressed on the polishing pad 11*a*. As a specific configuration example, the pressing mechanism 53 includes an electropneumatic regulator 531 that generates a predetermined pressure and a cylinder 532 that is provided on the dresser shaft 52 and elevates the dresser shaft 52 by the generated pressure. Pressing force generated by the pressing mechanism 53 can be adjusted by the pressure generated by the electropneumatic regulator 531.

The dresser rotation mechanism 54 includes a dresser motor driver 541 and a dresser motor 542. The dresser motor driver 541 supplies a drive current to the dresser motor 542. The dresser motor 542 is connected to the dresser shaft 52 and rotates the dresser shaft 52 by the drive current. As a result, the dresser 51 rotates. A rotation speed of the dresser 51 can be adjusted by the drive current.

One end of the dresser arm 55 supports the dresser shaft 52 rotatably. In addition, the other end of the dresser arm 55 is connected to the swinging mechanism 56.

The swinging mechanism 56 includes a support shaft 561, a swinging motor driver 562, and a swinging motor 563. An upper end of the support shaft 561 is connected to the other end of the dresser arm 55 and a lower end thereof is connected to the swinging motor 563. The swinging motor driver 562 supplies the drive current to the swinging motor 563. The swinging motor 563 rotates the support shaft 561 by the drive current. As a result, the dresser 51 swings (oscillates) between a center and an edge of the polishing pad 11*a*, on the polishing pad 11*a*. In addition, the swinging mechanism 56 detects a position and a swinging direction (oscillating direction) of the dresser 51 on the polishing pad 11*a*, by a detector (not illustrated in the drawings) such as a displacement sensor and an encoder.

The controller 6 wholly controls the polishing apparatus. The controller 6 may be a computer and may realize control to be described later by executing a predetermined program. The controller 6 according to this embodiment controls the pressing mechanism 53, based on the position and the swinging direction of the dresser 51 on the polishing pad 11*a*, such that force F of the dresser 51 cutting the polishing pad 11*a* becomes a predetermined target value Ftrg.

Figure 2:
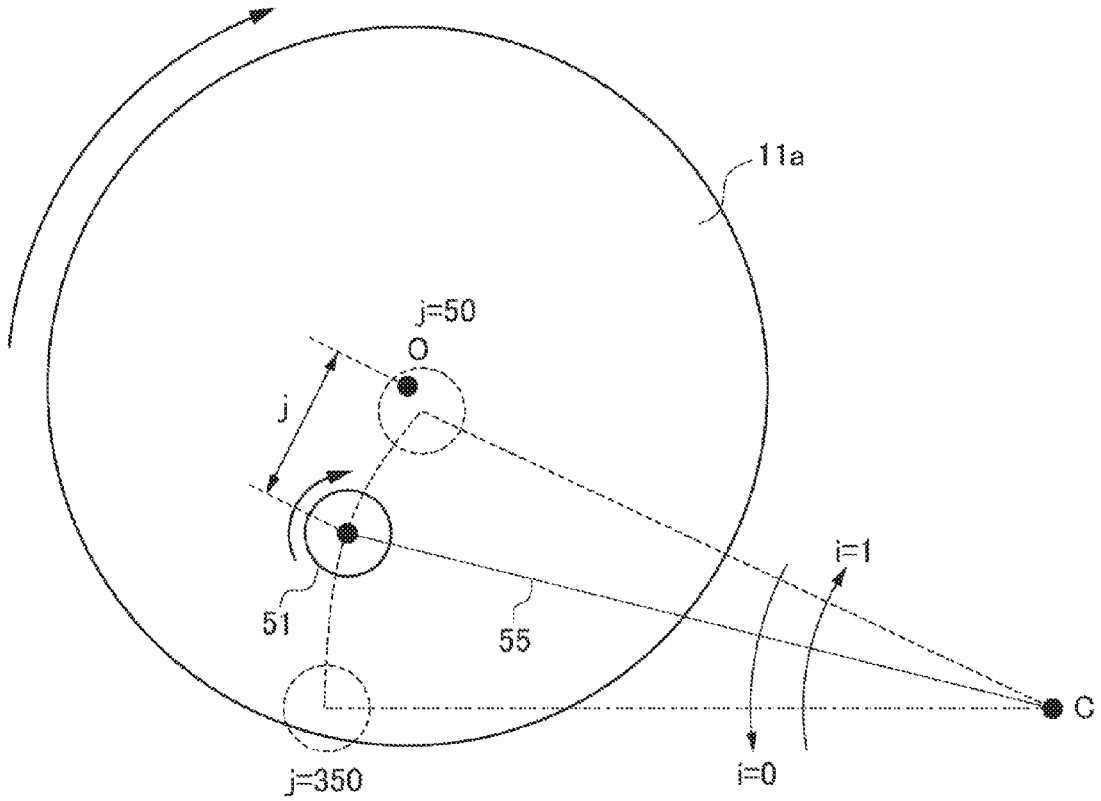
FIG. 2 is a plan view schematically illustrating swinging of the dresser 51 in the polishing pad 11*a*.

FIG. 2 is a plan view schematically illustrating swinging of the dresser 51 in the polishing pad 11*a*. The turn table rotation mechanism 12 rotates the polishing pad 11*a* provided on the turn table 11. Meanwhile, the swinging mechanism 56 swings the dresser 51 between a center O and an edge of the polishing pad 11*a*, based on the other end C (that is, a center of the support shaft 561) of the dresser arm 55 as a center. When the dresser arm 55 is sufficiently longer than a diameter of the polishing pad 11*a*, it is assumed that the dresser 51 swings in a radial direction of the polishing pad 11*a*.

A swinging direction i of the dresser 51 is represented by a binary value on whether the swinging direction is a direction (in this embodiment, i=0) toward the edge of the polishing pad 11*a* from the center O of the polishing pad 11*a* or a direction (i=1) toward the center O from the edge. A position j of the dresser 51 corresponds to a distance from the center O of the polishing pad 11*a* and is represented by a value between 50 and 350 in this embodiment. j=50 means that the dresser 51 is positioned at the center of the polishing pad 11*a* and j=350 means that the dresser 51 is positioned at the edge of the polishing pad 11*a*.

Returning to FIG. 1, dressing of the polishing pad 11*a* is performed as follows. The turn table 11 is rotated by the turn table rotation mechanism 12 while the dressing liquid is supplied from the dressing liquid supply nozzle 4 to the top surface of the polishing pad 11*a*, the dresser 51 is rotated by the dresser rotation mechanism 54, and the dresser 51 is swung by the swinging mechanism 56. In this state, the pressing mechanism 53 presses the dresser 51 on the surface of the polishing pad 11*a* and causes the dress disk 51*a* to slidably move on the surface of the polishing pad 11*a*. The surface of the polishing pad 11*a* is scraped by the rotating dresser 51. As a result, the dressing of the surface of the polishing pad 11*a* is performed.

Figure 3:
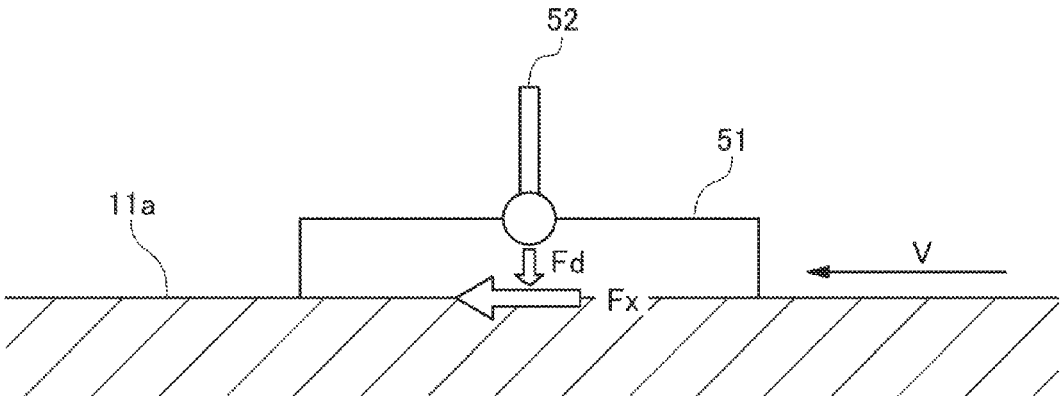
FIG. 3 is a diagram schematically illustrating force applied to the polishing pad 11*a* and the dresser 51 at the time of the dressing.

FIG. 3 is a diagram schematically illustrating force applied to the polishing pad 11*a* and the dresser 51 at the time of the dressing. As illustrated in FIG. 3, the dresser 51 is connected to the dresser shaft 52 via a swivel bearing. During the dressing of the polishing pad 11*a*, the dresser shaft 52 applies force of a downward direction to the dresser 51. As a result, the dresser 51 presses the polishing pad 11*a* with pressing force Fd.

Meanwhile, the surface of the rotating polishing pad 11*a* moves at a relative speed V with respect to the dresser 51. As a result, force Fx of a horizontal direction is applied to the dresser 51. Here, the force Fx of the horizontal direction corresponds to frictional force generated between a bottom surface (dressing surface) of the dresser 51 and the polishing pad 11*a*, when the dresser 51 scrapes the surface of the polishing pad 11*a*. Logically, the force Fx of the horizontal direction applied to the polishing pad 11*a* is proportional to the pressing force Fd by the dresser 51.

Figure 4:
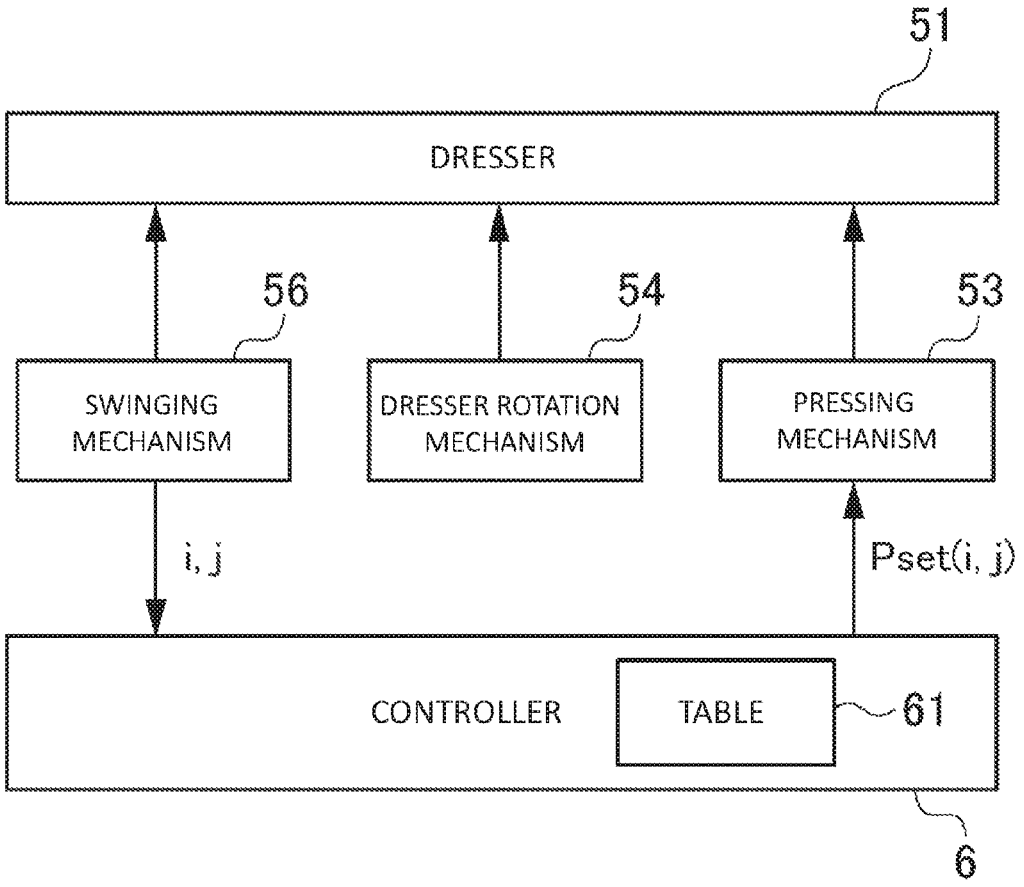
FIG. 4 is a block diagram illustrating control at the time of the dressing in the first embodiment.

FIG. 4 is a block diagram illustrating control at the time of the dressing in the first embodiment. As described above, the dresser 51 in the dressing unit 5 is swung on the polishing pad 11*a* by the swinging mechanism 56, is rotated by the dresser rotation mechanism 54, and is pressed on the surface of the polishing pad 11*a* by the pressing mechanism 53. Here, even though force of the dresser 51 pressing the polishing pad 11*a* (hereinafter, simply referred to as pressing force) Fd is controlled constantly, force of the dresser 51 cutting the polishing pad 11*a* (hereinafter, simply referred to as cutting force) F does not become constant. This will be described later.

Figure 5:
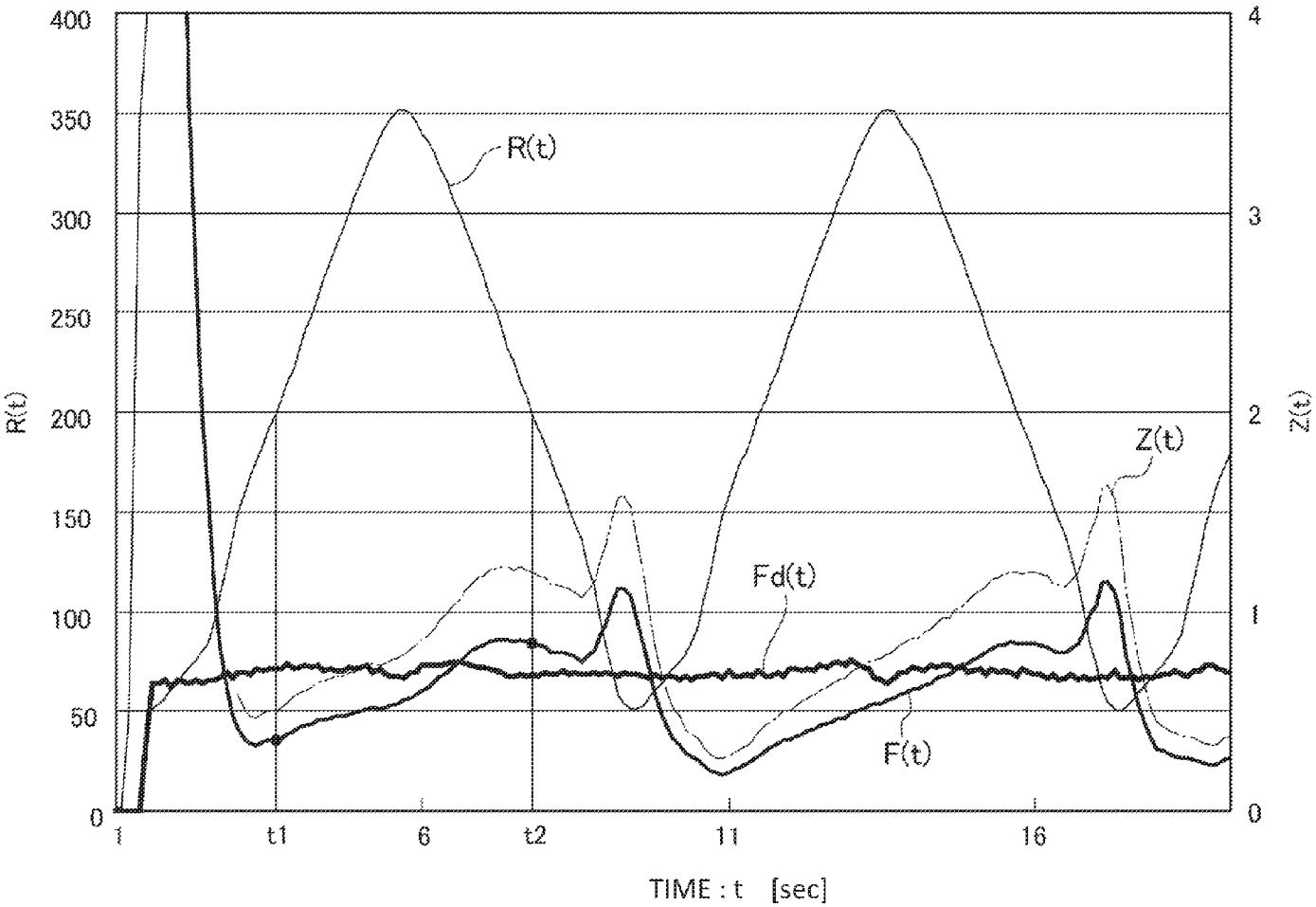
FIG. 5 is a diagram illustrating an example of a measurement result of a position R(t), pressing force Fd(t), cutting force F(t), and a frictional coefficient z(t) of the dresser 51, when the dresser 51 is moved and swung while the pressing force Fd(t) is controlled constantly.

FIG. 5 is a diagram illustrating an example of a measurement result of a position R(t), pressing force Fd(t), cutting force F(t), and a frictional coefficient z(t) of the dresser 51, when the dresser 51 is moved and swung while the pressing force Fd(t) is controlled constantly. In FIG. 5, a horizontal axis shows a time t.

The position R(t) (synonymous with the position j) of the dresser 51 is acquired from the swinging mechanism 56. A left vertical axis shows the position R(t) of the dresser 51. In a time region where a gradient of the position R(t) of the dresser 51 is positive, the dresser 51 moves in a direction toward the edge of the polishing pad 11*a* from the center thereof. Meanwhile, in a time region where the gradient of the position R(t) of the dresser 51 is negative, the dresser 51 moves in a direction toward the center of the polishing pad 11*a* from the edge thereof.

The pressing force Fd(t) is acquired from a product of a pressure applied from the electropneumatic regulator 531 to the cylinder 532 and an area of the cylinder 532 (or a load cell (not illustrated in the drawings) provided on a shaft between the dresser 51 and the cylinder 532).

Because the cutting force F(t) is almost equal to the force Fx of the horizontal direction applied to the polishing pad 11*a*, the cutting force F(t) is acquired by dividing a torque of the turn table 11 by the dressing (a difference of a torque Ttt of the turn table 11 and a steady torque T0 when the dresser 51 does not contact the polishing pad 11*a*) by a distance s(t) from the center of the polishing pad 11*a* of the dresser 51. Here, the torque T is acquired by multiplying a drive current I detected by the current detector 123 and a torque constant Km [Nm/A] unique to the turn table motor 122. In addition, the distance s(t) is determined uniquely according to the position R(t) of the dresser 51.

Because the force of the horizontal direction (that is, the cutting force F(t)) applied to the polishing pad 11*a* corresponds to the frictional force between the dresser 51 and the polishing pad 11*a*, the frictional coefficient z(t) is defined by the following formula (1).

$$z(t)=F(t)/Fd(t) \tag{1}$$

As can be seen from FIG. 5, the pressing force Fd(t) is almost constant. However, the cutting force F(t) is not constant. More specifically, the cutting force F(t) depends on a swinging direction as well as the position R(t) of the dresser 51. For example, at times t1 and t2 when the position R(t) becomes 200, the cutting force F(t1) when the swinging direction is the direction toward the edge from the center is weaker than the cutting force F(t2) when the swinging direction is the direction toward the center from the edge.

The reason why the cutting force F(t) is different according to the swinging direction of the dresser 51 as described above is that the cutting force F(t) is determined by the frictional force between the dresser 51 and the polishing pad 11*a*, but the frictional force depends on a relative speed of the dresser 51 and the polishing pad 11*a*. For example, if the dresser 51 and the polishing pad 11*a* move (rotate) in the same direction, the relative speed decreases. For this reason, the friction decreases and the cutting force F(t) decreases. Meanwhile, if the dresser 51 and the polishing pad 11*a* move (rotate) in opposite directions, the relative speed increases. For this reason, the friction increases and the cutting force F(t) increases. In the above example, because the relative speed of the dresser 51 and the polishing pad 11*a* at the time t1 is lower than the relative speed at the time t2, it is thought that F(t1)<F(t2) is satisfied.

Because the relative speed changes every moment due to rotation of the turn table 11, rotation of the dresser 51, and swinging of the dresser 51, the frictional coefficient z(t) also changes. As a result, the cutting force F(t) is not constant.

Therefore, in this embodiment, the pressing force Fd(t) is adjusted in real time by considering the change in the frictional coefficient z(t) according to the swinging direction, instead of causing the pressing force Fd(t) to be constant.

That is, as illustrated in FIG. 4, the controller 6 acquires the swinging direction i and the position j of the dresser 51 from a detector (not illustrated in the drawings) of the swinging mechanism 56, such as a displacement sensor and an encoder. In addition, the controller 6 outputs a control signal Pset(i, j), such that the cutting force F becomes a predetermined target value Ftrg. At this time, the controller 6 may use a table 61 in which values of the control signal Pset(i, j) to cause the cutting force F to become the target value Ftrg for each swinging direction i and position j of the dresser 51 are predetermined.

The control signal Pset(i, j) shows a pressure to be applied to the cylinder 532 of the pressing mechanism 53. In addition, the electropneumatic regulator 531 applies the pressure according to the control signal Pset(i, j) to the cylinder 532. According to the pressure, the cylinder 532 vertically moves the dresser 51 via the dresser shaft 52. As a result, the dresser 51 can cut the surface of the polishing pad 11*a* according to the target value Ftrg.

FIG. 6 is a diagram illustrating an example of a structure of the table 61 included in the controller 6. As illustrated in FIG. 6, a value of the control signal Pset(i, j) to cause the cutting force to become the target value Ftrg is previously determined for each swinging direction i and position j of the dresser 51. The table 61 can be determined experimentally and can be generated as follows, for example.

Figure 7:
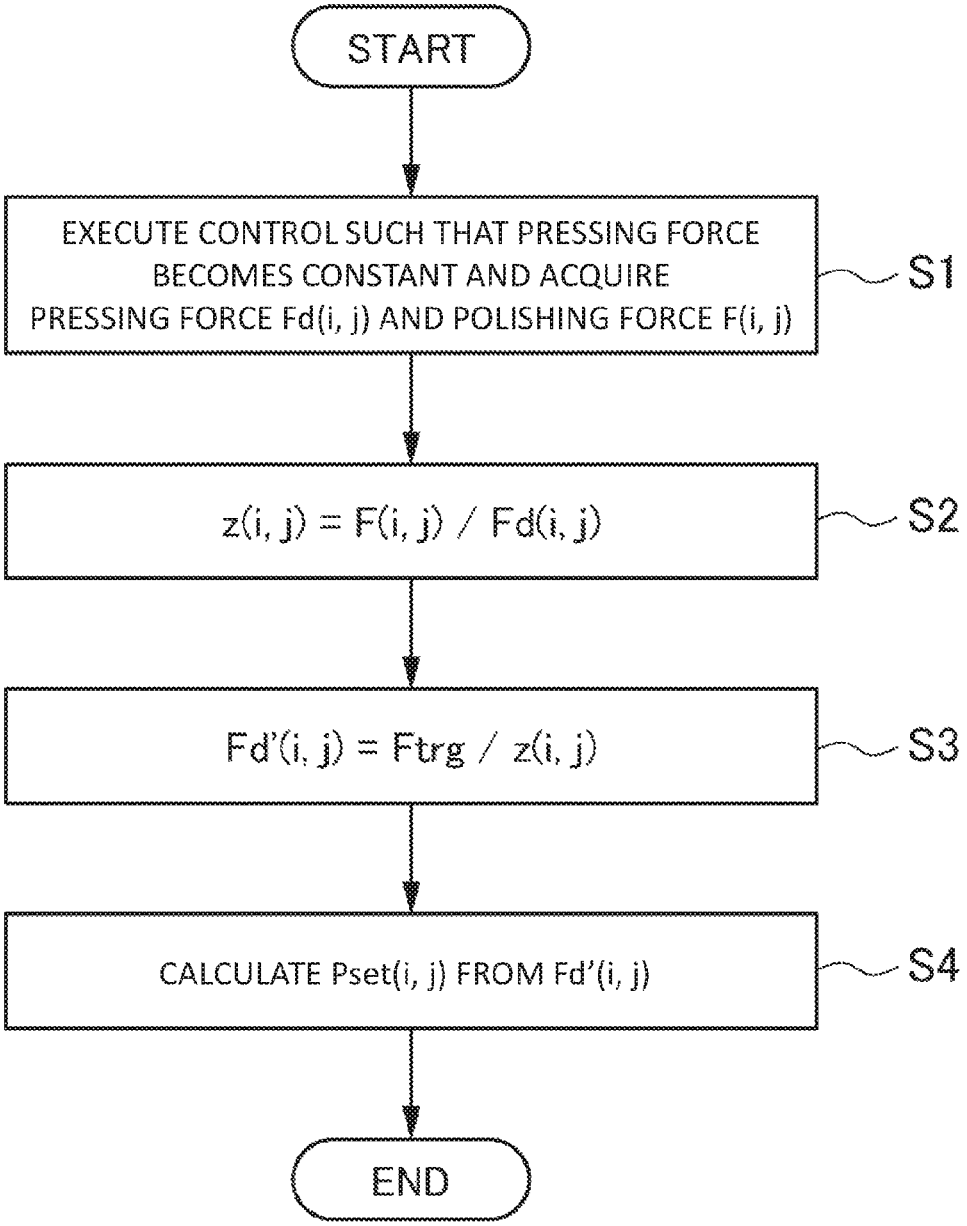
FIG. 7 is a flowchart illustrating an example of a method of generating the table 61.

FIG. 7 is a flowchart illustrating an example of a method of generating the table 61. First, the dresser 51 is moved and swung while it is controlled such that the pressing force Fd becomes constant, and the position R(t), the pressing force Fd(t), and the cutting force F(t) of the dresser 51 illustrated in FIG. 5 are measured. Pressing force Fd(i, j) and cutting force F(i, j) as functions of the swinging direction i and the position j of the dresser 51 are obtained from the pressing force Fd(t) and the cutting force F(t), based on a measurement result (step S1).

Then, a frictional coefficient z(i, j) for each swinging direction i and position j of the dresser 51 is calculated by the following formula (1') (step S2).

$$z(i, j)=F(i, j)/Fd(i, j) \tag{1'}$$

Next, pressing force Fd'(i, j) to cause the cutting force to become the target value Ftrg is calculated for each swinging direction i and position j of the dresser 51, based on the following formula (2) (step S3).

$$Fd'(i, j)=F\mathrm{trg}/z(i, j) \tag{2}$$

A pressure (that is, a control signal) Pset(i, j) to be applied from the electropneumatic regulator 531 to the cylinder 532 to obtain desired pressing force Fd'(i, j) is calculated in consideration of characteristics of the cylinder 532 and the dresser shaft 52 (step S4). A conversion from the pressing force Fd'(i, j) to the pressure Pset(i, j) can be executed using a known method.

In this way, the table 61 illustrated in FIG. 6 can be generated. The controller 6 may output the pressing force Fd'(i, j) as the control signal according to the swinging direction i and the position j of the dresser 51 and an operator (not illustrated in the drawings) provided in the controller 6 or separately from the controller 6 may calculate the pressure Pset(i, j) from the pressing force Fd'(i, j). The operator may calculate the pressure based on predetermined initial pressing force, when the control signal Fd'(i, j) is not input from the controller 6.

In addition, a pitch width of the position j of the dresser 51 in the table 61 is preferably equal to or smaller than a diameter D of the dresser 51, more preferably about D/3 to D. For example, when the diameter D of the dresser 51 is 1/10 of a diameter of the polishing pad 11*a*, a portion between the center and the edge of the polishing pad 11*a* may be divided by 10 to 30. This is because the electropneumatic regulator 531 and the cylinder 532 do not respond so fast, the stable pressing force Fd cannot be generated when the pitch width is excessively minute.

As such, in the first embodiment, the pressing mechanism 53 is controlled based on the swinging direction i and the position j of the dresser 51, and the pressing force Fd is adjusted. Therefore, the polishing pad 11*a* can be dressed uniformly.

Second Embodiment

In a second embodiment to be described below, a rotation speed of a turn table 11 is adjusted. Hereinafter, a difference with the first embodiment will be mainly described.

Figure 8:
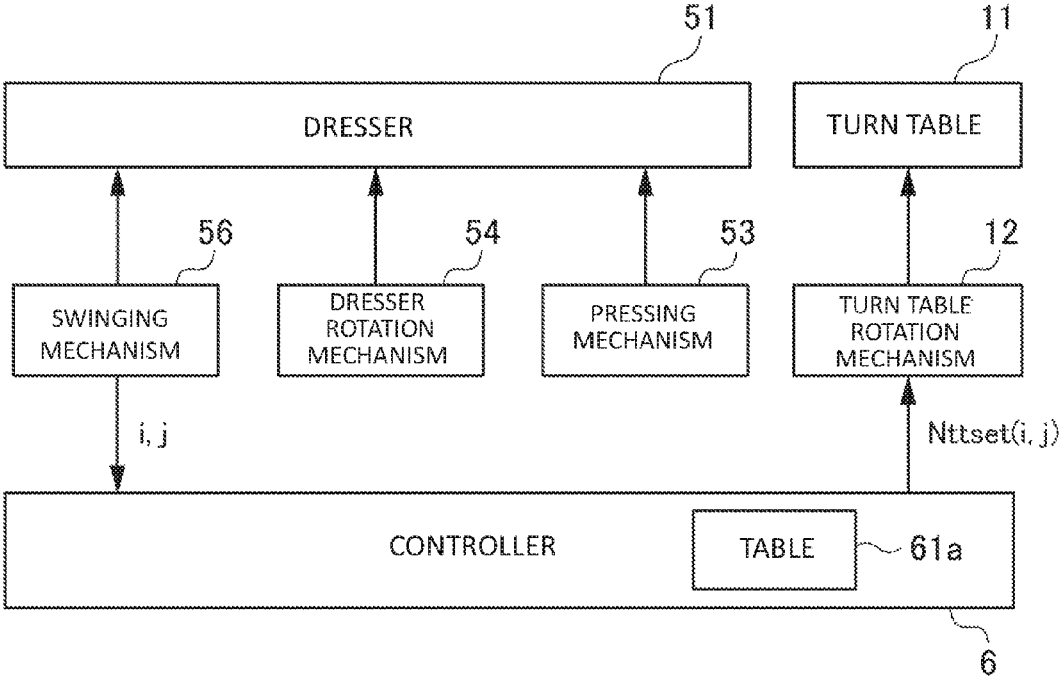
FIG. 8 is a block diagram illustrating control at the time of dressing in the second embodiment.

FIG. 8 is a block diagram illustrating control at the time of dressing in the second embodiment. In this embodiment, a controller 6 may not control a pressing mechanism 53. Instead, the controller 6 controls a turn table rotation mechanism 12. That is, the controller 6 outputs a control signal Nttset(i, j) to cause cutting force F to become a predetermined target value Ftrg, according to a swinging direction i and a position j of a dresser 51, in consideration of a variation of a frictional coefficient z. At this time, the controller 6 may use a table 61*a* in which values of the control signal Nttset(i, j) to cause the cutting force to become the target value Ftrg for each swinging direction i and position j of the dresser 51 are predetermined.

The control signal Nttset(i, j) shows the rotation speed of the turn table 11. The turn table rotation mechanism 12 rotates the turn table 11 according to the control signal Nttset(i, j). As a result, the dresser 51 can cut a surface of a polishing pad 11*a* by the target value Ftrg.

FIG. 9 is a diagram illustrating an example of a structure of the table 61*a* included in the controller 6. As illustrated in FIG. 9, a value of the control signal Nttset(i, j) to cause the cutting force to become the target value Ftrg is previously determined for each swinging direction i and position j of the dresser 51.

The table 61*a* can be generated as follows. First, similar to the first embodiment, cutting force F(i, j) is acquired as a function of the swinging direction i and the position j of the dresser 51. Then, an increase/decrease amount of the rotation speed of the turn table 11 from an initial value Ntt0 to cause the cutting force F(i, j) to approximate to the target value Ftrg is experimentally acquired for each swinging direction i and position j of the dresser 51. Then, a value obtained by adding the initial value Ntt0 and the increase/decrease amount is set as a table value Nttset(i, j).

In addition, the table 61*a* can be generated by a different method. If it is assumed that the frictional coefficient z does not depend on a swinging direction of the dresser 51 and is constant, a relation of a rotation torque Ttt of the turn table 11 and a ratio Ntt/Ndr (Ntt is a rotation rate Ntt of the turn table 11, and Ndr is a rotation rate of the dresser 51) can be obtained by numerical calculation, in consideration of a coupling effect of the turn table 11 and the dresser 51. Then, the rotation torque Ttt is divided by the position j of the dresser 51, so that a relation of the ratio Ntt/Ndr of the rotation rates and force F0(Ntt/Ndr) for each position j is obtained.

Figure 10:
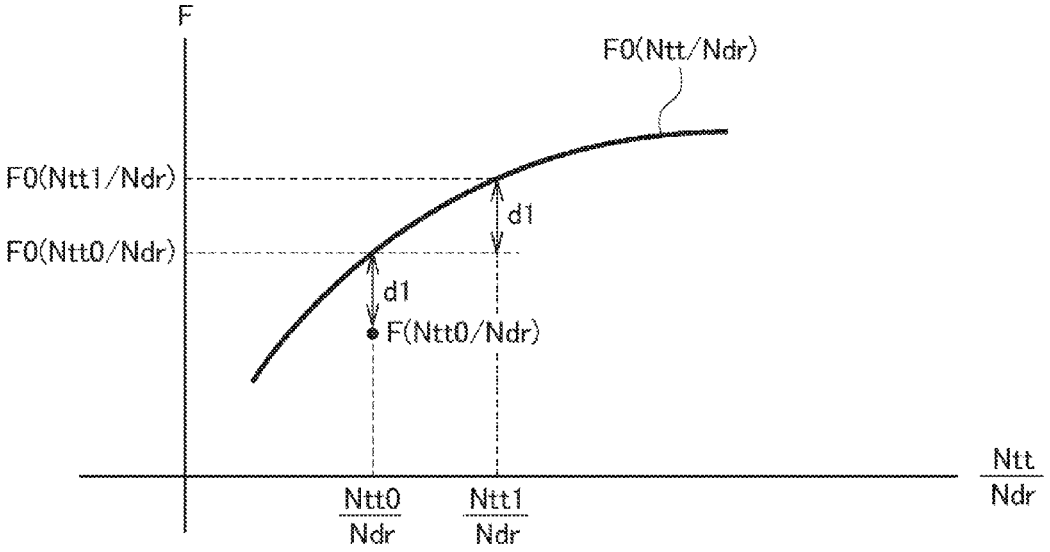
FIG. 10 is a diagram schematically illustrating the relation of the ratio Ntt/Ndr of the rotation rates and the force F0(Ntt/Ndr).

FIG. 10 is a diagram schematically illustrating the relation of the ratio Ntt/Ndr of the rotation rates and the force F0(Ntt/Ndr). The force F0(Ntt/Ndr) illustrated in FIG. 10 is calculated for each position j of the dresser 51.

Next, the dresser 51 is operated where the rotation rate of the dresser 51 is set as Ndr, the rotation rate of the turn table 11 is set as an initial value Ntt0, to obtain a rotation torque Ttt in the case of a swinging direction i1 and a position j1 is acquired, and the rotation torque Ttt is divided by the position j to calculate the force F(Ntt0/Ndr) is calculated. The force F(Ntt0/Ndr) is actual force of the dresser 51 cutting the polishing surface 11*a*.

The calculated force F(Ntt0/Ndr) does not exist on a curve of the force F0(Ntt/Ndr) illustrated in FIG. 10. The reason is that the force F0(Ntt/Ndr) is obtained on the assumption that the frictional coefficient z is constant regardless of the swinging direction of the dresser 51, but the frictional coefficient z varies according to the swinging direction i as described above, in actuality.

Therefore, a difference between the force F(Ntt0/Ndr) and the force F0(Ntt0/Ndr) is set as d1 and a rotation rate Ntt1 of the turn table 11 satisfying F0(Ntt1/Ndr)=F0(Ntt0/Ndr)+d1 is calculated. The rotation rate Ntt1 is set as a control signal Nttset (i1, j1) in the swinging direction i1 and the position j1 of the table 61*a*.

The above process is executed for all values of i and j, so that the table 61 can be determined.

In this embodiment, because the turn table rotation mechanism 12 is controlled, responsiveness is good. For this reason, the pitch width of the position j of the dresser 51 in the table 61*a* may be set minutely more than the pitch width in the first embodiment and the rotation speed of the turn table 11 can be varied moderately.

As such, in the second embodiment, the turn table rotation mechanism 12 is controlled based on the swinging direction i and the position j of the dresser 51 to adjust the rotation speed of the turn table 11. For this reason, the polishing pad 11*a* can be dressed uniformly. In addition, responsiveness can be improved as compared with the first embodiment in which the pressing mechanism 53 of the pneumatic control system including the electropneumatic regulator 531 and the cylinder 532 is controlled.

Third Embodiment

In a third embodiment to be described below, a rotation speed of a dresser 51 is adjusted. Hereinafter, a difference with the first and second embodiments will be mainly described.

Figure 11:
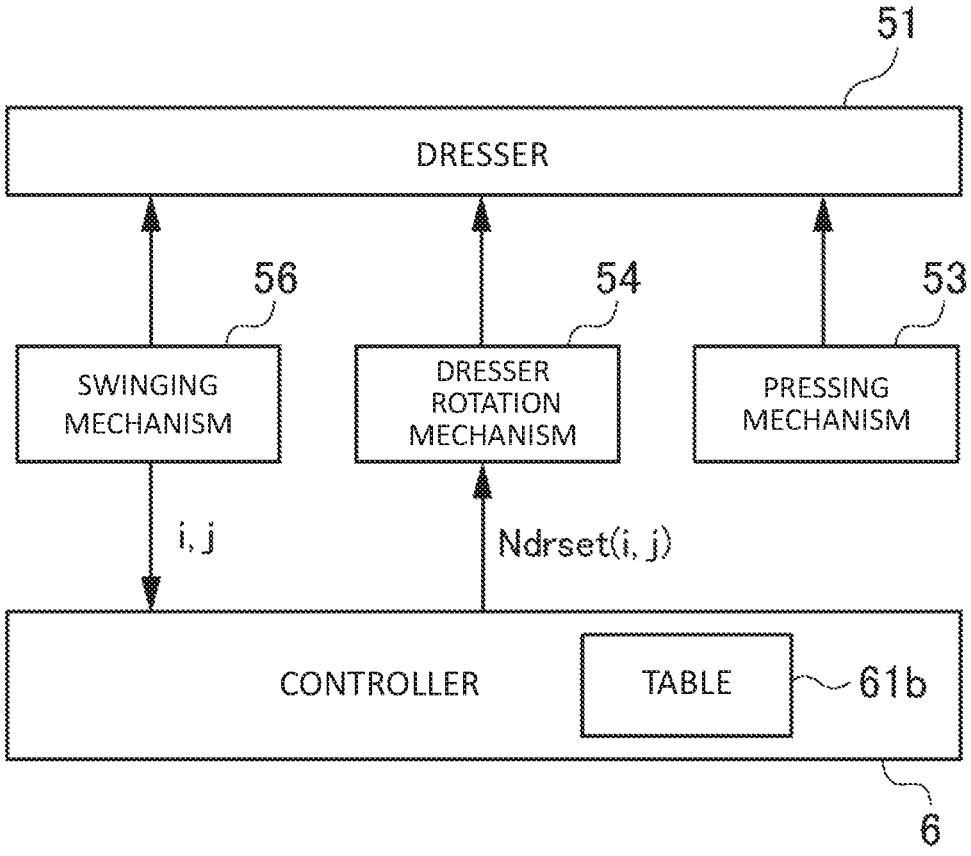
FIG. 11 is a block diagram illustrating control at the time of dressing in the third embodiment.

FIG. 11 is a block diagram illustrating control at the time of dressing in the third embodiment. In this embodiment, a controller 6 may not control a pressing mechanism 53 and a turn table rotation mechanism 12. Instead, the controller 6 controls a dresser rotation mechanism 54. That is, the controller 6 outputs a control signal Ndrset(i, j) to cause cutting force F to become a predetermined target value Ftrg, according to a swinging direction i and a position j of the dresser 51, in consideration of a variation of a frictional coefficient z. At this time, the controller 6 may use a table 61*b* in which values of the control signal Ndrset(i, j) to cause the cutting force F to become the target value Ftrg for each swinging direction i and position j of the dresser 51 are predetermined.

The control signal Ndrset (i, j) shows the rotation speed of the dresser 51. The dresser rotation mechanism 54 rotates the dresser 51 according to the control signal Ndrset(i, j). As a result, the dresser 51 can cut a surface of a polishing pad 11*a* according to the target value Ftrg.

FIG. 12 is a diagram illustrating an example of a structure of the table 61*b* included in the controller 6. As illustrated in FIG. 12, a value of the control signal Ndrset(i, j) to cause the cutting force F to become the target value Ftrg is previously determined for each swinging direction i and position j of the dresser 51. The table 61*b* can be generated as follows.

First, similar to the first embodiment, cutting force F(i, j) is acquired as a function of the swinging direction i and the position j of the dresser 51. Next, an increase/decrease amount of the rotation speed of the dresser 51 from an initial value Ndr0 to cause the cutting force F(i, j) to approximate to the target value Ftrg is experimentally acquired for each swinging direction i and position j of the dresser 51. Then, a value obtained by adding the initial value Ndr0 and the increase/decrease amount is set as a table value Ndrset(i, j).

In addition, the table 61*b* may be determined by the same method as the method described using FIG. 10 in the second embodiment. That is, after the relation of FIG. 10 is acquired, a rotation rate of the dresser 51 is set as the initial value Ndr0, a rotation rate of the turn table 11 is set as Ntt, the dresser 51 is operated, a rotation torque Ttt in the case of a swinging direction i1 and a position j1 is acquired, the rotation torque Ttt is divided by the position j, and force F(Ntt/Ndr0) is calculated.

A difference of the force F(Ntt/Ndr0) and the force F0(Ntt/Ndr0) is set as d1 and a rotation rate Ndr1 of the dresser 51 satisfying F0(Ntt/Ndr1)=F0(Ntt/Ndr0)+d1 is calculated. The rotation rate Ndr1 is set as a control signal Ndrset(i1, j1) in the swinging direction i1 and the position j1 of the table 61*b*.

The above process is executed for all values of i and j, so that the table 61 can be determined.

In this embodiment, because the dresser rotation mechanism 54 is controlled, responsiveness is good. For this reason, a pitch width of the position j of the dresser 51 in the table 61*b* may be set minutely more than the pitch width in the first embodiment and the rotation speed Ndr of the dresser 51 can be varied moderately.

As such, in the third embodiment, the dresser rotation mechanism 54 is controlled based on the swinging direction i and the position j of the dresser 51 to adjust the rotation speed of the dresser 51. For this reason, the polishing pad 11*a* can be dressed uniformly. In addition, responsiveness can be improved as compared with the first embodiment in which the pressing mechanism 53 of the pneumatic control system including the electropneumatic regulator 531 and the cylinder 532 is controlled.

Fourth Embodiment

In the first to third embodiments, control is performed such that the cutting force F becomes the target value Ftrg, using the table 61 (and the tables 61*a* and 61*b*, which is applied to the following description) of the controller 6. In a fourth embodiment, actual force Fact of a dresser 51 cutting a polishing pad 11*a* is detected, and the actual force Fact is compared with the target value Ftrg, so as to determine whether a value set in the table 61 is appropriate. As a result, even though the polishing pad 11*a* and the dresser 51 are worn and friction between the polishing pad 11*a* and the dresser 51 is changed, the table 61 can be updated at appropriate timing.

Figure 13:
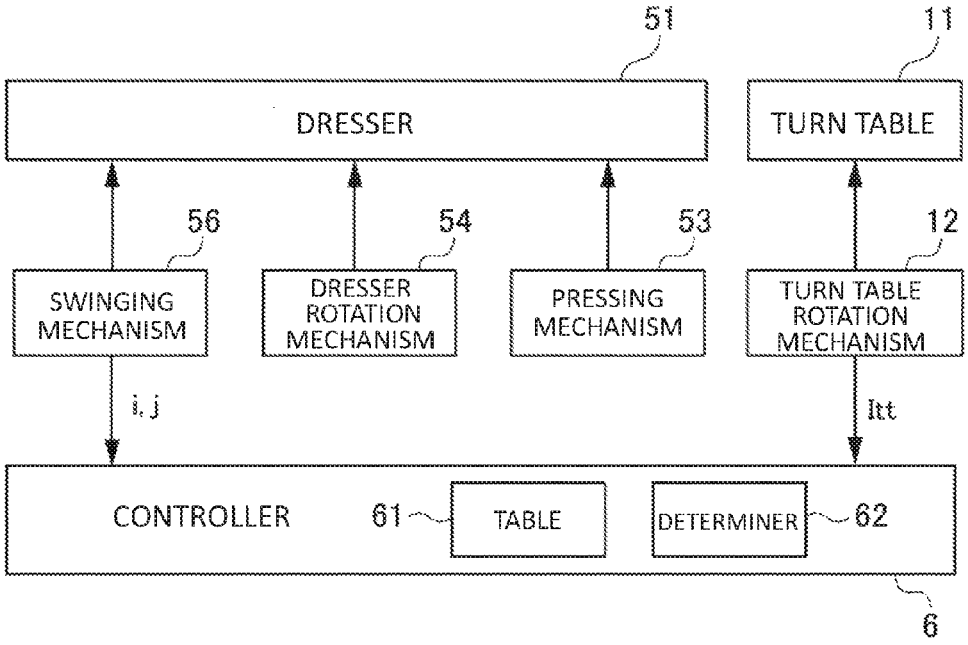
FIG. 13 is a block diagram illustrating control at the time of dressing in the fourth embodiment.

FIG. 13 is a block diagram illustrating control at the time of dressing in the fourth embodiment. Although not illustrated in FIG. 13, the controller 6 controls a pressing mechanism 53 (first embodiment) as illustrated in FIG. 4, controls a turn table rotation mechanism 12 (second embodiment) as illustrated in FIG. 8, or controls a dresser rotation mechanism 54 (third embodiment) as illustrated in FIG. 11 and can be applied to all of the first to third embodiments.

The controller 6 according to this embodiment acquires a drive current Itt supplied to a turn table motor 122 at the time of the dressing, from a current detector 123 in the turn table rotation mechanism 12. In addition, the controller 6 has a determiner 62. The determiner 62 monitors the actual force Fact cutting the polishing pad 11*a* in real time, based on the drive current Itt, during the dressing. In addition, the determiner 62 determines whether the value of the table 61 is appropriate, based on a difference of the actual force Fact and the target value Ftrg.

Figure 14:
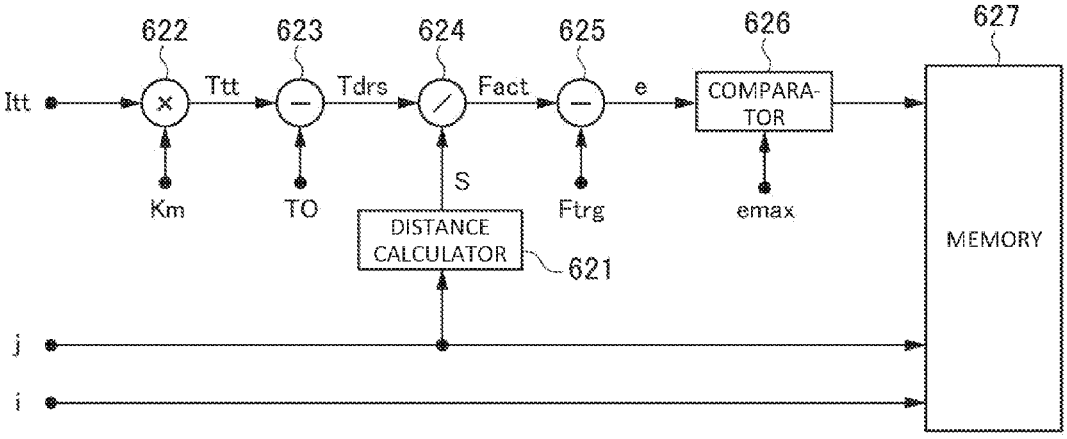
FIG. 14 is a block diagram illustrating a configuration example of the determiner 62.

FIG. 14 is a block diagram illustrating a configuration example of the determiner 62. The determiner 62 has a distance calculator 621, a multiplier 622, a subtractor 623, a divider 624, a subtractor 625, a comparator 626, and a memory 627.

The distance calculator 621 calculates a distance S of the dresser 51 from a center of the polishing pad 11*a*, based on a position j of the dresser 51. The multiplier 622 multiplies the drive current Itt and a torque constant Km of the turn table motor 122 to calculate a torque Ttt of the turn table 11. The subtractor 623 subtracts a steady torque T0 from the torque Ttt of the turn table 11 to calculate a torque Tdrs of the turn table 11 by the dressing. The divider 624 divides the torque Tdrs of the turn table 11 by the dressing by the distance S to calculate the actual force Fact of the dresser 51 polishing force the polishing pad 11*a*. The subtractor 625 subtracts the target value Ftrg from the actual force Fact to calculate a deviation e. The comparator 626 compares the deviation e and a predetermined threshold value emax to determine whether the value of the table 61 is appropriate.

When the deviation e is smaller than the threshold value emax, approximating the actual force Fact of the dresser 51 polishing force the polishing pad 11*a* to the target value Ftrg can be realized by control of the controller 6 using the table 61. Therefore, it is determined that the value of the table 61 is appropriate.

Meanwhile, when the deviation e is equal to or larger than the threshold value emax, approximating the actual force Fact of the dresser 51 polishing force the polishing pad 11*a* to the target value Ftrg cannot be realized by control of the controller 6 using the table 61. Therefore, it is determined that the value of the table 61 is not appropriate. In the case of such a determination result, an alarm may be given.

The memory 627 stores a swinging direction i and a position j of the dresser 51 associated with a determination result at that time. What is stored in the memory 627 may be displayed graphically on a display device (not illustrated in the drawings) to visually recognize in which swinging direction i and position j the deviation e becomes equal to or larger than the threshold value emax.

A user can determine whether the value of the table needs to be updated, based on the alarm or what is displayed on the display device. When the value of the table 61 needs to be updated, the value of the table 61 is newly set by the method of FIG. 7.

As such, in the fourth embodiment, the actual force Fact of the dresser 51 polishing force the polishing pad 11*a* is calculated, so that propriety of the value of the table 61 can be determined, and an update timing of the table 61 can be determined.

Note that, in the fourth embodiment, the actual force Fact of the dresser 51 polishing force the polishing pad 11*a* is calculated from the drive current Itt supplied to the turn table motor 122. However, the actual force Fact may be calculated by other known method. For example, the determiner 62 may acquire the torque Tdr by the dressing from a distortion of a rotation axis of the turn table 11 to calculate the actual force Fact from the torque Tdr and the distance S of the dresser 51 from the center of the polishing pad 11*a*. In addition, the determiner 62 may calculate the actual force Fact from force applied to a bearing housing supporting a dresser shaft 52 or a bearing housing supporting a support shaft 561.

Fifth Embodiment

In a fifth embodiment to be described below, it is determined whether a value of the table 61*a* in the second embodiment is appropriate, by a method different from the method according to the fourth embodiment. Hereinafter, a difference with the fourth embodiment will be described.

A determiner 62 stores a difference d1 in FIG. 10, that is, a difference d1 between force F0(Ntt0/Ndr) calculated on the assumption that a frictional coefficient z is constant and force F(Ntt0, Ndr) at the time of generating the table 61*a*, for each swinging direction i and position j of a dresser 51.

In addition, a rotation rate of the dresser 51 is set as Ndr, a rotation rate of the turn table 11 is set as an initial value Ntt0, the dresser 51 is operated, and the force F(Ntt0/Ndr) is calculated from a rotation torque Ttt in the case of a swinging direction i1 and a position j1.

At this time, a difference d1' of the force F(Ntt0/Ndr) and the force F0(Ntt0/Ndr) has to be matched with the difference d1. However, if a polishing pad 11*a* and the dresser 51 are worn, the difference d1' has a value different from the difference d1.

Therefore, the determiner 62 determines whether the value of the table 61*a* is appropriate, based on the difference d1'. For example, the determiner 62 can determine that the value of the table 61*a* is not appropriate, when the difference of the differences d1' and d1 is equal to or larger than a threshold value.

As such, in the fifth embodiment, propriety of the value of the table 61*a* can be determined and an update period of time of the table 61*a* can be determined. In addition, it is obvious that this embodiment can be applied to the table 61*b* in the third embodiment.

As described above, in the present embodiment, the pressing mechanism 53, the turn table rotation mechanism 12, or the dresser rotation mechanism 54 is controlled in consideration of the swinging direction of the dresser 51. For this reason, it is possible to cause the force F polishing the polishing pad 11*a* to approximate to the target value Ftrg, regardless of the position and the swinging direction on the polishing pad 11*a*. As a result, the polishing pad 11*a* can be dressed surely in short time, polishing performance can be maintained, and productivity of the polishing apparatus can be improved.

The embodiments are described to enable a person with ordinary skill in the technical field to which the embodiment belongs to carry out the embodiment. Various modifications of the embodiments can be carried out by those skilled in the art and the technical spirit of the embodiment can be applied to other embodiments. Therefore, the embodiment is not limited to the embodiments and should be analyzed in a widest range according to the technical spirit defined by claims.

The invention claimed is:

1. A polishing apparatus comprising:

a turn table on which a polishing pad for polishing a substrate is provided;

a turn table rotation mechanism configured to rotate the turn table;

a dresser configured to dress the polishing pad by cutting a surface of the polishing pad;

a pressing mechanism configured to press the dresser onto the polishing pad;

a dresser rotation mechanism configured to rotate the dresser;

a swinging mechanism configured to swing the dresser on the polishing pad; and a controller configured to control the pressing mechanism, the turn table rotation mechanism or the dresser rotation mechanism based on a position and a swinging direction of the dresser.

2. The polishing apparatus of claim 1, wherein the controller controls the pressing mechanism, the turn table rotation mechanism or the dresser rotation mechanism so that a force of the dresser to cut the surface of the polishing pad becomes a target value.

3. The polishing apparatus of claim 1, wherein the controller controls the pressing mechanism, the turn table rotation mechanism or the dresser rotation mechanism taking into consideration that a ratio between a force of the dresser to press the polishing pad and the force of the dresser to cut the surface of the polishing pad depends on the swinging direction of the dresser.

4. The polishing apparatus of claim 1, wherein the controller controls the pressing mechanism to adjust a force of the dresser to press the polishing pad, controls the turn table rotation mechanism to adjust a rotation speed of the turn table, or controls the dresser rotation mechanism to adjust a rotation speed of the dresser.

5. The polishing apparatus of claim 1, wherein the swinging mechanism swings the dresser between a center of the polishing pad and an edge thereof, and the controller controls the pressing mechanism, the turn table rotation mechanism or the dresser rotation mechanism based on whether the swinging direction is a direction from the center to the edge or a direction from the edge to the center.

6. The polishing apparatus of claim 1, wherein the controller comprises a table in which a control signal is determined, the control signal being a signal to set a force of the dresser to cut the surface of the polishing pad to become a target value for each position and swinging direction of the dresser, the controller outputting the control signal depending on the position and the swinging direction of the dresser, and controls the pressing mechanism, the turn table rotation mechanism or the dresser rotation mechanism based on the control signal.

7. The polishing apparatus of claim 6, wherein the controller comprises a determiner configured to determine whether or not the control signal in the table is appropriate based on an actual force of the dresser to cut the surface of the polishing pad and the target value.

8. The polishing apparatus of claim 7, wherein the determiner comprises a memory configured to store the position and the swinging direction of the dresser associated with a determination result.

9. The polishing apparatus of claim 7, wherein the controller calculate the actual force of the dresser to cut the surface of the polishing pad:

from a driving current supplied to a turn table motor in the turn table rotation mechanism and the position of the dresser;

from a distortion of a rotation axis of the turn table and the position of the dresser;

from a force applied on a support member to support a rotation axis of the dresser; or from a force applied on a support member to support a support axis of the dresser.

10. A method of controlling a polishing apparatus, the polishing apparatus comprising:

a turn table on which a polishing pad for polishing a substrate is provided;

a turn table rotation mechanism configured to rotate the turn table;

a dresser configured to dress the polishing pad by cutting a surface of the polishing pad;

a pressing mechanism configured to press the dresser onto the polishing pad;

a dresser rotation mechanism configured to rotate the dresser; and a swinging mechanism configured to swing the dresser on the polishing pad, the method comprising:

detecting a position and a swinging direction of the dresser; and controlling the pressing mechanism, the turn table rotation mechanism or the dresser rotation mechanism based on the position and the swinging direction of the dresser.

11. A dressing method for cutting a surface of a polishing pad on a turn table, said method comprising:

rotating the turn table and a dresser;

cutting the surface of the polishing pad by pressing and oscillating the dresser against the polishing pad;

detecting a position and a oscillating direction of the dresser on the polishing pad; and adjusting a pressing force of the dresser, a rotating speed of the turn table or a rotating speed of the dresser based on said detecting.

12. The dressing method of claim 11, wherein the pressing force of the dresser, the rotating speed of the turn table or the rotating speed of the dresser is adjusted so that a force of the dresser to cut the surface of the polishing pad becomes a target value.

13. The dressing method of claim 11, wherein the pressing force of the dresser, the rotating speed of the turn table or the rotating speed of the dresser is adjusted taking into consideration that a ratio between a force of the dresser to press the polishing pad and a force of the dresser to cut the surface of the polishing pad depends on the oscillating direction of the dresser.

14. The dressing method of claim 11, wherein the pressing force of the dresser is adjusted by controlling a pressing mechanism which is configured to press the dresser onto the polishing pad;

the rotating speed of the turn table is adjusted by controlling a turn table rotation mechanism which is configured to rotate the turn table; or the rotating speed of the dresser is adjusted by controlling a dresser rotation mechanism which is configured to rotate the dresser.

15. The method of claim 11, wherein the dresser is oscillated between a center of the polishing pad and an edge thereof, and whether the oscillating direction of the dresser is a direction from the center to the edge or a direction from the edge to the center is detected.

16. The method of claim 11 further comprising outputting a control signal depending on the position and the oscillating direction of the dresser using a table in which the control signal is determined, the control signal being a signal to set a force of the dresser to cut the surface of the polishing pad to become a target value for each position and oscillating direction of the dresser, wherein the pressing force of the dresser, the rotating speed of the turn table or the rotating speed of the dresser is adjusted based on the control signal.

17. The method of claim 16 further comprising determining whether or not the control signal in the table is appropriate based on an actual force of the dresser to cut the surface of the polishing pad and the target value.

18. The method of claim 17 further comprising storing the position and the oscillating direction of the dresser associated with a determination result.

19. The method of claim 17, wherein the actual force of the dresser to cut the surface of the polishing pad is calculated:

from the position of the dresser and a driving current supplied to a turn table motor in a turn table rotation mechanism which is configured to rotate the turn table;

from a distortion of a rotation axis of the turn table and the position of the dresser;

from a force applied on a support member to support a rotation axis of the dresser; or from a force applied on a support member to support a support axis of the dresser.

* * * * *